US006938592B2

(12) United States Patent
Taylor et al.

(10) Patent No.: US 6,938,592 B2
(45) Date of Patent: Sep. 6, 2005

(54) CONTROL METHOD FOR ELECTRO-HYDRAULIC CONTROL VALVES OVER TEMPERATURE RANGE

(75) Inventors: Danny R. Taylor, Freeville, NY (US); Stanley B. Quinn, Jr., Elmhurst, IL (US)

(73) Assignee: BorgWarner Inc., Auburn Hills, MI (US)

( * ) Notice: Subject to any disclaimer, the term of this patent is extended or adjusted under 35 U.S.C. 154(b) by 209 days.

(21) Appl. No.: 10/408,999

(22) Filed: Apr. 4, 2003

(65) Prior Publication Data

US 2004/0003788 A1 Jan. 8, 2004

Related U.S. Application Data

(60) Provisional application No. 60/389,202, filed on Jun. 17, 2002.

(51) Int. Cl.[7] ..... F01L 1/34

(52) U.S. Cl. ..... 123/90.15; 123/90.17; 123/90.31; 123/694

(58) Field of Search ..... 123/90.11, 90.15, 123/90.16, 90.17, 90.18, 90.27, 90.31, 693, 694; 251/129.01, 129.05, 129.15; 700/28, 31

(56) References Cited

U.S. PATENT DOCUMENTS

| | | | | | |
|---|---|---|---|---|---|
| 4,313,165 | A | * | 1/1982 | Clelford et al. | 701/3 |
| 4,378,773 | A | * | 4/1983 | Ohgami | 123/694 |
| 5,002,023 | A | | 3/1991 | Butterfield et al. | 123/90.15 |
| 5,107,804 | A | | 4/1992 | Becker et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,657,725 | A | | 8/1997 | Butterfield et al. | 123/90.17 |
| 6,247,434 | B1 | | 6/2001 | Simpson et al. | 123/90.17 |
| 6,250,265 | B1 | | 6/2001 | Simpson | 123/90.17 |
| 6,263,846 | B1 | | 7/2001 | Simpson et al. | 123/90.17 |
| 6,311,655 | B1 | | 11/2001 | Simpson et al. | 123/90.17 |
| 6,374,787 | B2 | | 4/2002 | Simpson et al. | 123/90.17 |
| 6,477,999 | B1 | | 11/2002 | Markley | 123/90.17 |
| 6,722,325 | B2 | * | 4/2004 | Shimizu et al. | 123/90.15 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

In a variable cam timing (VCT) system (10*a*) which has a feedback control loop wherein an error signal (36) relating to at least one sensed position signal of either a crank shaft position (24*a*) or at least one cam shaft position (22*a*) is fed back for correcting a predetermined command signal (12). The system further includes a valve (14) for controlling a relative angular relationship of a phaser (42); and includes a variable force solenoid (20) for controlling a translational movement of the valve (14). An improved control method comprising the steps of: providing a dither signal (38) sufficiently smaller than the error signal (36); as temperature varies, changing at least one parameter relating to the dither signal (38); and applying the dither signal (38) upon the variable force solenoid (20), thereby using the dither signal (38) for overcoming a system hysteresis without causing excessive movement of valve (14).

5 Claims, 10 Drawing Sheets

Fig. 5
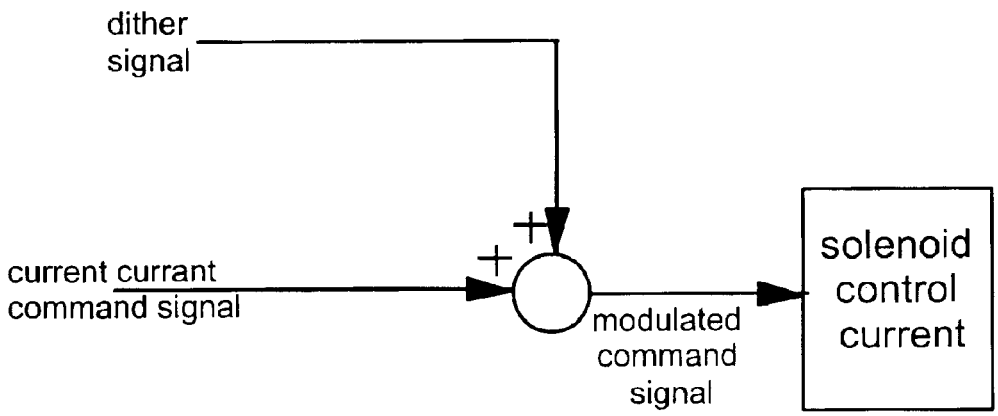
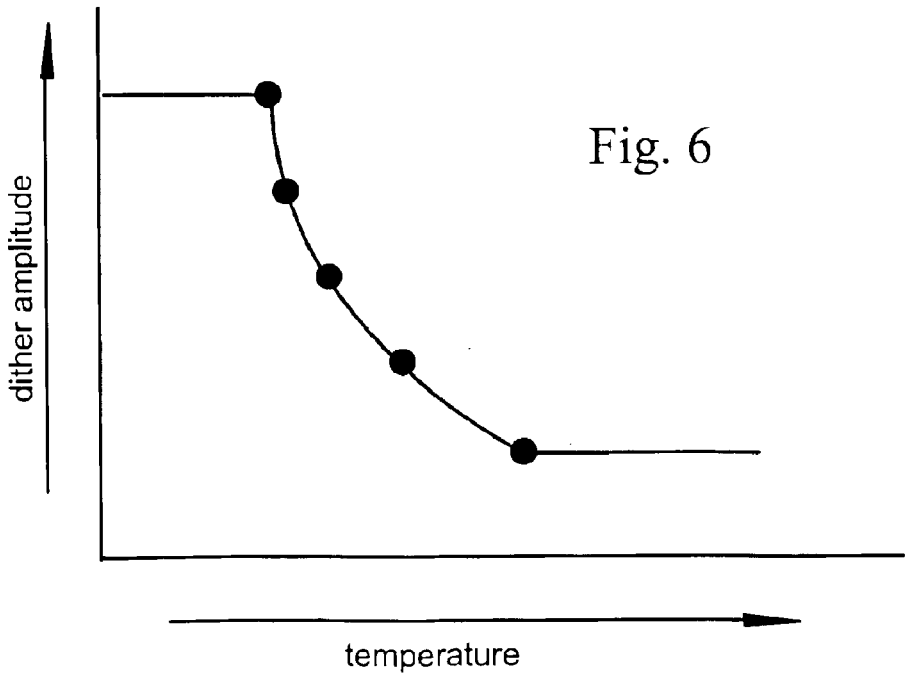
Fig. 6

CONTROL METHOD FOR ELECTRO-HYDRAULIC CONTROL VALVES OVER TEMPERATURE RANGE

REFERENCE TO RELATED APPLICATIONS

This application claims an invention which was disclosed in Provisional Application No. 60/389,202, filed Jun. 17, 2002, entitled "IMPROVED CONTROL METHOD FOR ELECTRO-HYDRAULIC CONTROL VALVES OVER TEMPERATURE RANGE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention improves closed loop control, over an entire temperature range, by modifying a dither amplitude and frequency as a function of temperature.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

In an electro-hydraulic control system, it is important to minimize the positional hysteresis of the control valve, in order to achieve good control characteristics. Mechanical friction and magnetic hysteresis are the two largest factors contributing to the positional hysteresis. A commonly known method for overcoming these effects is to apply "dither" to the control valve. The "dither", which is simply a periodic modulation of the command signal, serves to move the valve slightly back and forth, which negates the difference between the static and dynamic coefficients of friction, since the valve is constantly moving slightly.

The method of injecting dither varies with the control architecture. In the case of a proportional solenoid actuator, the solenoid current is modulated in some fashion. With a current control solenoid driver, a "dither" signal is added to the current command signal The wave shape of the dither signal may be a square wave, sine wave, or a triangle wave, and may be unipolar (positive only) or bipolar (both positive & negative). Also, the dither signal can be generated either in the embedded controller software, or in the controller hardware. With a VCT system using PWM control, the dither is inherent in the PWM signal.

In all cases, it is important that the appropriate amount of dither is applied. If too little is applied, then little or no improvement of the control valve hysteresis is seen. If too much dither is applied, then the control valve will move back and forth around the "null" position too far, which will adversely affect the control pressures or flows. The correct amount of dither is chosen based on the dynamics of the VCT system. The basis for the choices include: solenoid force characteristics; solenoid armature mass; solenoid friction; control valve mass; spring rates; control valve friction; hydraulic flow, hydraulic pressure, and hydraulic damping effects. As the temperature varies, several of the factors that affect the system dynamics change accordingly. The most significant factor is the viscosity of the lubricating oil used in the VCT system, e.g., a vane type phaser therein. At lower temperatures, the viscosity increases, making the oil "thicker". This changes the hydraulic effects on the control valve, which in turn reduces the effectiveness of the "dither" to improve the control valve hysteresis.

Referring to FIG. 1, a prior art feedback loop 10 is shown. The control objective of feedback loop 10 is to have the VCT phaser at the correct phase (set point 12) and the phase rate of change be reduced to zero. In this state, the spool valve 14 is in its null position and no fluid flows (ideally) between two fluid holding chambers of a phaser (not shown). A computer program product which utilizes the dynamic state of the VCT mechanism is used to accomplish the above state.

The VCT closed-loop control mechanism is achieved by measuring a camshaft phase shift .$\theta_0$ 16, and comparing the same to the desired set point 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point r 12 and phase shift 20) is non-zero.

The spool 14 is moved toward a first direction (e.g. right) if the phase error is positive (retard) and to a second direction (e.g. left) if the phase error is negative (advance). When the phase error is zero, the VCT phase equals the set point 12 so the spool 14 is held in the null position such that ideally no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a,* respectively. The sensed pulses are used by a phase measurement device 26. A measurement of the cam position or phase expressed as $\theta_0$ 16 is then determined. This phase measurement is then supplied to the control law 18 for reaching the desired spool position.

To minimize a positional hysteresis of the control valve, i.e. a solenoid and a spool valve in combination, a dither signal is known to be applied to a command signal for minimizing hysteresis effect. In a VCT system, the hysteresis effect changes with temperature. Therefore, it is desirous to have a method that varies the dither signal parameters according to temperature.

SUMMARY OF THE INVENTION

An improved method using a dither signal to overcome system hysteresis over a significant range of temperatures is provided.

Accordingly, in a variable cam timing (VCT) system which has a feedback control loop wherein an error signal relating to at least one sensed position signal of either a crank shaft position or at least one cam shaft position is fed back for correcting a predetermined command signal. The system further includes a valve for controlling a relative angular relationship of a phaser; and includes a variable force solenoid for controlling a translational movement of the valve. An improved control method comprising the steps of: providing a dither signal sufficiently smaller than the error signal; as temperature varies, changing at least one parameter relating to the dither signal; and applying the dither signal upon the variable force solenoid, thereby using the dither signal for overcoming a system hysteresis without causing excessive movement of valve.

BRIEF DESCRIPTION OF THE DRAWING

FIG. 5 shows a dither signal added to the current command signal.

FIG. 6 shows a relationship between the dither amplitude and changing temperature.

DETAILED DESCRIPTION OF THE INVENTION

Figure 1:
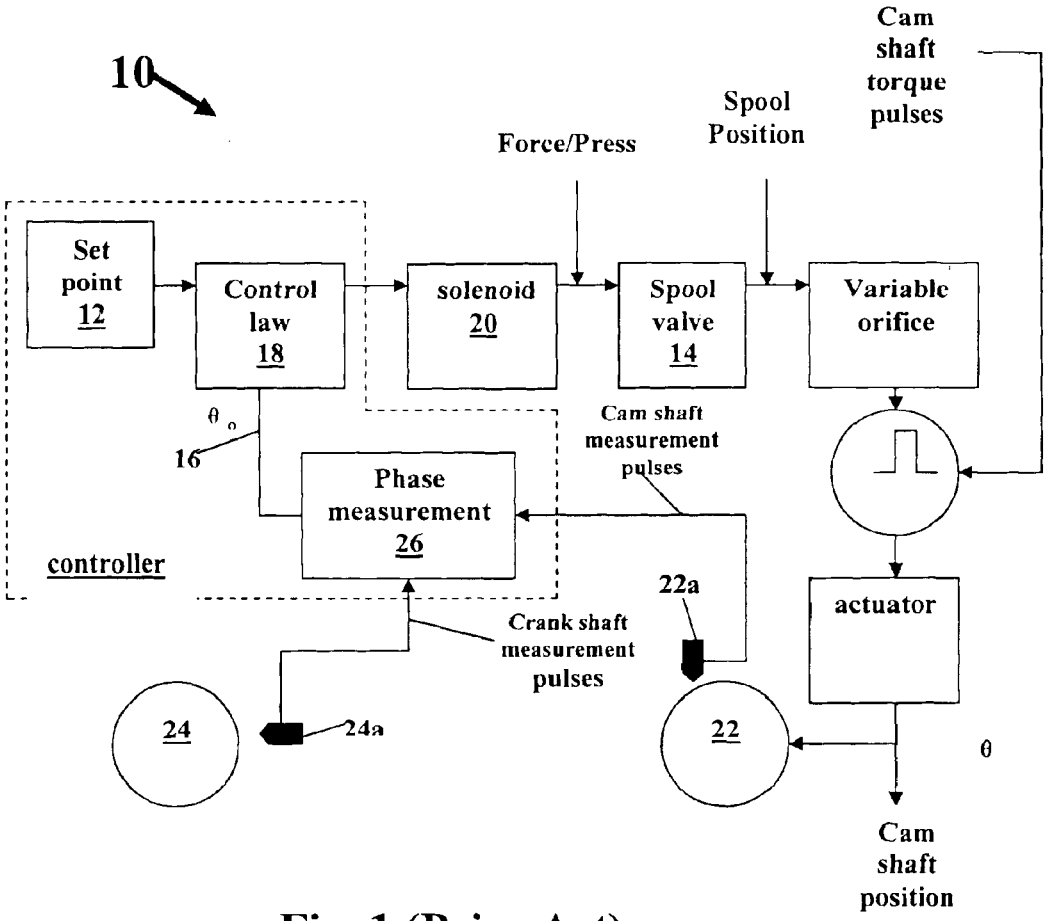
Fig. 1 (Prior Art)
FIG. 1 shows a prior art feedback control loop.
Figure 2:
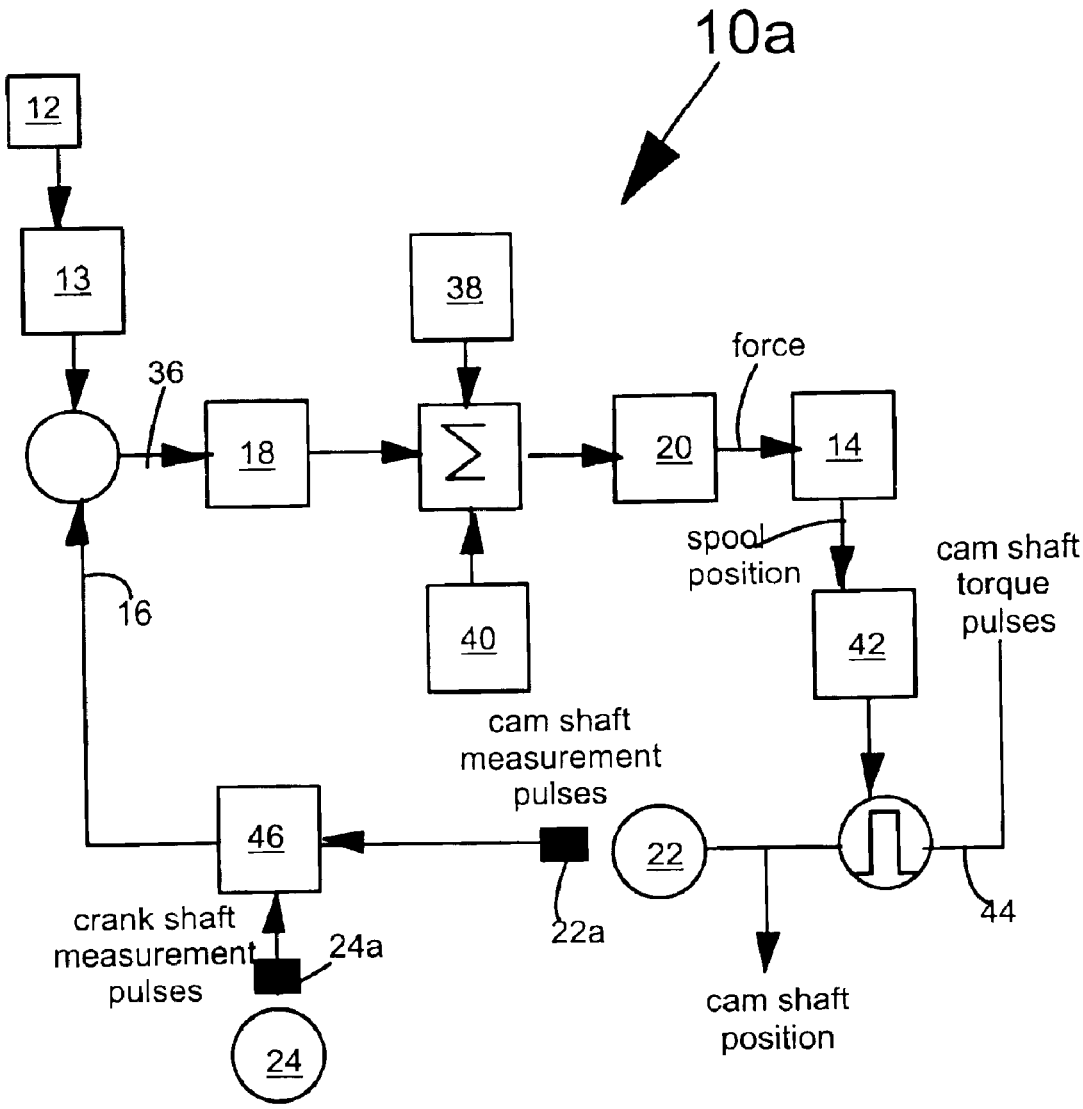
FIG. 2 shows feedback control loop with dither signal added thereto.

Referring to FIG. 2, an overall control diagram 10*a* for a cam torque actuated variable cam timing (VCT) device and method incorporating the instant invention are shown. It is noted that some numbers in FIG. 2 corresponds with numbers of FIG. 1 and are similar in function and character. A set point signal 12 is received from an engine controller (not shown) and fed into set point filter 13 to smooth the sudden change of set point 12 and reduce overshoot in closed-loop control response. The filtered set point signal 12 forms part of an error signal 36. The other part that forms the error signal 36 is a measured phase signal 16 which will be further described infra. By way of example, the error signal 36 may be generated by subtracting the measured phase 16 from the filtered set point 12. At this juncture, the error signal 36 is subjected to control law 18.

The output of control law 18, in conjunction with dither signal 38 and null duty cycle signal 40, are summed up and form the input value to drive solenoid 20 which in this case may be a variable force solenoid thereby minimizing positional hysteresis of the control valve. Dither signal 38, if properly used, is disposed to overcome any friction and magnetic hysteresis of the solenoid 20 and spool valve 14. However, temperature variation of the VCT system may alter the system inertia such that a first dither signal at a first temperature is not suitable for a second temperature. For example, when the temperature changes, the friction quality of lubricating oil in the VCT system changes accordingly. Spool valve 14 having the lubricating oil coating would have its movement affected in that the same friction quality causes spool to move under a different condition. Therefore dither signal 38 applied upon solenoid 20 would have an altered effect on the spool because of temperature change.

The null duty cycle 40 is the nominal duty cycle for the spool 14 to stay in its middle position (null position) whereby fluid-flow in either direction is blocked. The variable force solenoid 20 moves spool valve 14 which may be a center mounted spool valve to block the flow of fluid such as engine lubricating oil within VCT phaser 42 in either one direction or the other. Thus the VCT phaser 42 is enabled to move towards the desired direction under oscillating cam torque 44. When the VCT phaser 42 moves to a desired position which is predetermined by set point 12, the center mounted spool valve 14 would be driven to its middle position (null position), thereby the VCT phaser is hydraulically locked and stays thereat. If the set point 12 changes or the VCT phaser 42 shift away due to disturbance, the above process loops again.

The positions of the cam shaft and crankshaft are respectively sensed by sensors 22*a* and 24*a*. The sensors may be any type of position sensors including a magnetic reluctance sensor that senses tooth position of the wheels 22 and 24 which are rigidly attached respectively to cam and crank shaft of a suitable internal combustion engine.

The sensed signals of position sensors 22 and 24 respectively are typically in the form of tooth pulses. The tooth pulses are subjected to phase calculation 46 and its output fed back as phase signal 16 which is used to reach a desired position according to the predetermined set point 12. Set point 12 is generated by a controller (not shown) such as an engine control unit.

Figure 3:
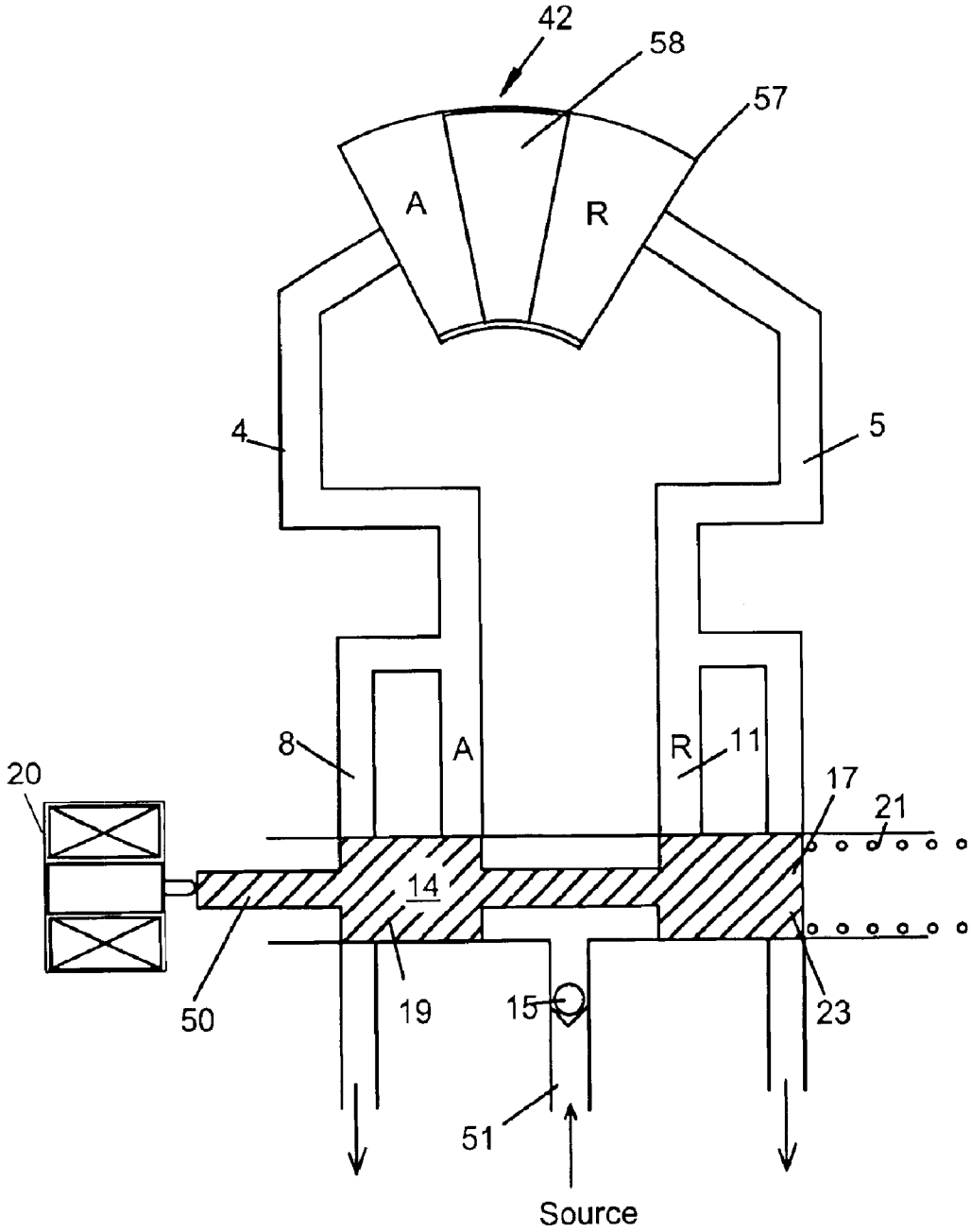
FIG. 3 shows a first type of VCT system suitable of the present invention.

FIG. 3 is a schematic depiction of one type of VCT system. A null position is shown in that no fluid flows because spool valve closes all fluid flow ducts in the null position. Solenoid 20 engages spool valve 14 by exerting a first force upon the same on a first end 50. The first force is met by a force of equal strength exerted by spring 21 upon a second end 17 of spool valve 14 thereby maintaining the null position. The spool valve 14 includes a first block 19 and a second block 23 each of which blocks fluid flow respectively. Solenoid 20 may be a pulse width modulated (PWM) variable force solenoid in which a duty cycle of PWM can be controlled for generating a dither signal inherent in the PWM system. In other words, the power of the PWM system can be controlled in such a way that the current flowing through solenoid 20 coil may be attenuated or not reaching maximum value.

The phaser 42 includes a vane 58, a housing 57 using the vane 58 to delimit an advance chamber A and a retard chamber R therein. Typically, the housing and the vane 58 are coupled to crank shaft (not shown) and cam shaft (also not shown) respectively. Vane 58 is permitted to move relative to the phaser housing 57 by adjusting the fluid quantity of advance and retard chambers A and R. If it is desirous to move vane 58 toward the advance side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 51 and is in one-way fluid communication with duct 11 by means of one-way valve 15, thereby supplying fluid to chamber R via duct 5. This can occur because block 23 moved further right causing the above one-way fluid communication to occur. When the desired vane position is reached, the spool valve is commanded to move back left to its null position, thereby maintaining a new phase relationship of the crank and cam shaft.

As can be seen in FIG. 3, without adjustment in temperature compensation, the dither signal stays constant. Yet temperature causes a change in the VCT system such as a change in the viscosity of engine lubricating in contact with VCT parts such as the spool valve 14. Without adjusting dither signal parameters to compensate for temperature variations, the dither 38 may cause undesirable effects on the VCT system such as unintended oil flow with the system. As can be appreciated, some changes in the dither signal for compensating temperature change is needed. A detailed discussion about the same in listed infra.

Figure 4:
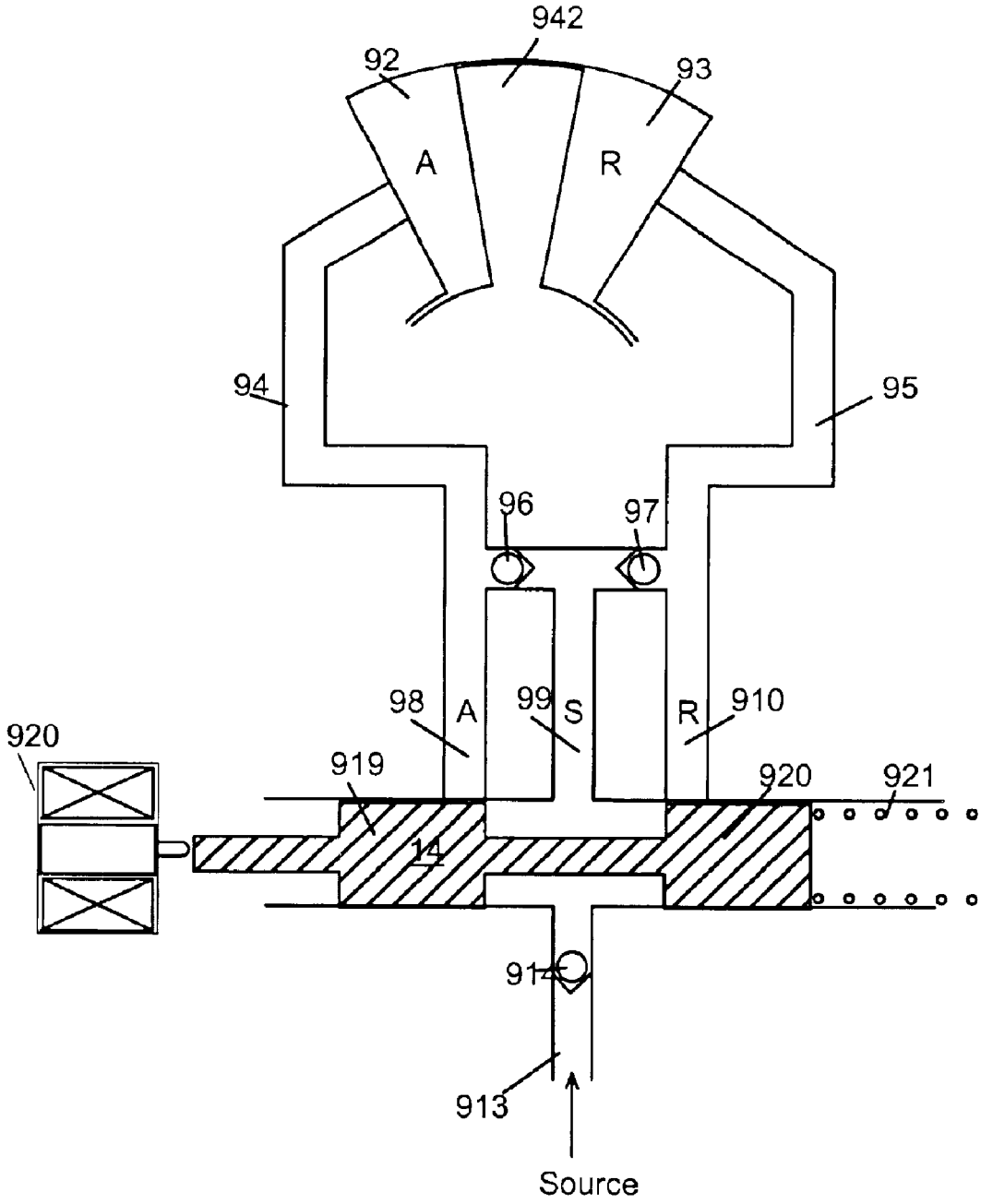
FIG. 4 shows a second type of VCT system suitable of the present invention.

Referring to FIG. 4, another VCT system is shown. Specifically, a Cam Torque Actuated (CTA) VCT system is depicted. The CTA system uses torque reversals in camshaft caused by the forces of opening and closing engine valves to move vane 942. The control valve in a CTA system allows fluid flow from advance chamber 92 to retard chamber 93 or vice versa, allowing vane 942 to move, or stops flow, locking vane 942 in position. CTA phaser may also have oil input 913 to make up for losses due to leakage, but does not use engine oil pressure to move phaser.

The operation of CTA phaser system is as follows. FIG. 4 depicts a null position in that ideally no fluid flow occurs because the spool valve 14 stops fluid circulation at both advance end 98 and retard end 910. When cam angular relationship is required to be changed, vane 942 necessarily needs to move. Solenoid 920, which engages spool valve 14, is commanded to move spool 14 away from the null position thereby causing fluid within the CTA circulation to flow. It is pointed out that the CTA circulation ideally uses only local fluid without any fluid coming from source 913. However, during normal operation, some fluid leakage occurs and the fluid deficit needs to be replenished by the source 913 via a one way valve 914. The fluid in this case may be engine oil. The source 913 may be the engine oil pump.

There are two scenarios for the CTA phaser system. First, there is the Advance scenario, wherein an Advance chamber 92 needs to be filled with more fluid than in the null position. In other words, the size or volume of chamber 92 is increased. The advance scenario is accomplished by way of the following.

Solenoid 920, preferably of the pulse width modulation (PWM) type, pushes the spool valve 14 toward right such that the left portion 919 of the spool valve 14 still stops fluid flow at the advance end 98. But simultaneously the right portion 920 moved further right leaving retard portion 910 in fluid communication with duct 99. Because of the inherent torque reversals in camshaft, drained fluid from the retard chamber 93 feeds the same into advance chamber 92 via one-way valve 96 and duct 94.

Similarly, for the second scenario which is the retard scenario wherein a Retard chamber 93 needs to be filled with more fluid than in the null position. In other words, the size or volume of chamber 93 is increased. The retard scenario is accomplished by way of the following.

Solenoid 920, preferably of the pulse width modulation (PWM) type, reduces its engaging force with the spool valve 14 such that an elastic member 921 forces spool 14 to move left. The right portion 920 of the spool valve 14 stops fluid flow at the retard end 910. But simultaneously the left portion 919 moves further left leaving Advance portion 98 in fluid communication with duct 99. Because of the inherent torque reversals in camshaft, drained fluid from the Advance chamber 92 feeds the same into Retard chamber 93 via one-way valve 97 and duct 95.

As can be appreciated, with the CTA cam phaser, the inherent cam torque energy is used as the motive force to re-circulate oil between the chambers 92, 93 in the phaser. This varying cam torque arises from alternately compressing, then releasing, each valve spring, as the camshaft rotates.

Referring to FIG. 5, a dither adding scheme in a current control system is shown. A current control command signal acts upon a solenoid (not shown) for controlling a valve such as the spool valve 14. A dither signal which generally has a much smaller amplitude in relation to the current control command signal is added to the current control command signal to form a modulated command signal. It is modulated in that the dither signal alters some characteristics of the current control command signal. The modulated command signal generates a solenoid control current that may control spool valve 14. The dither signal can be controlled or modulated by altering its frequency and amplitude individually or a combination of both frequency and amplitude.

Referring to FIG. 6, a first case of current control is depicted which involves changing only dither amplitude. In this case, a controller only has the ability to change the dither amplitude directly. This operation is straight forward in that the dither amplitude is increased as the temperature is decreased. The actual shape of the curve is adjusted to provide the optimum performance.

Figure 7:
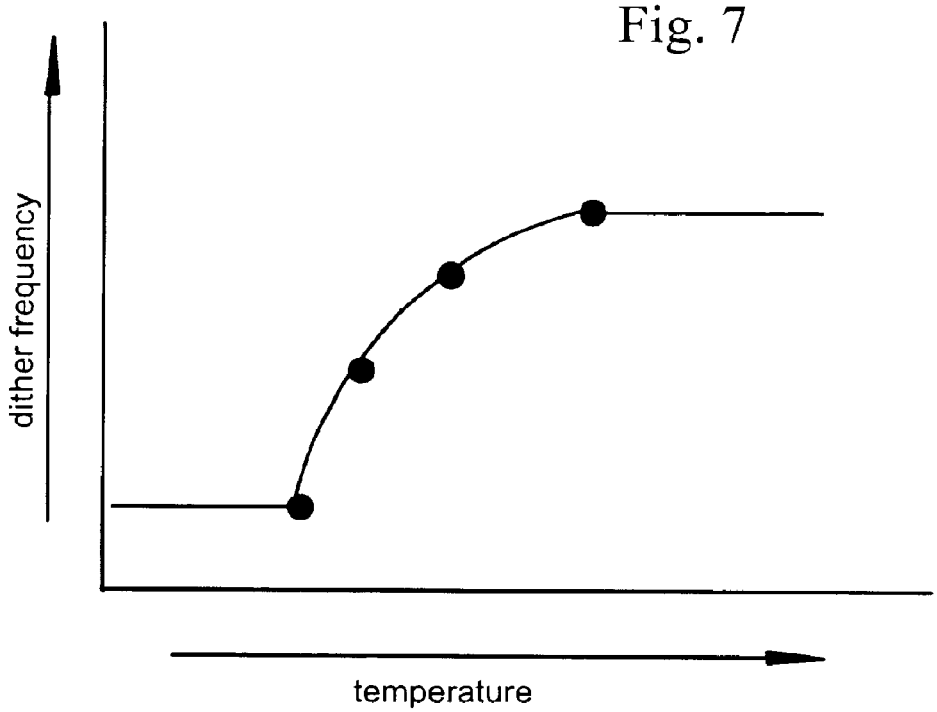
FIG. 7 shows a relationship between the dither frequency and changing temperature.

Referring to FIG. 7, a second case of current control by changing only dither frequency is depicted. In this case, the controller only has the ability to change the dither frequency directly. Similar with the first case, this operation is straightforward. The dither frequency is decreased as the temperature is decreased. The actual shape of the curve is adjusted to provide the optimum performance.

Figure 8:
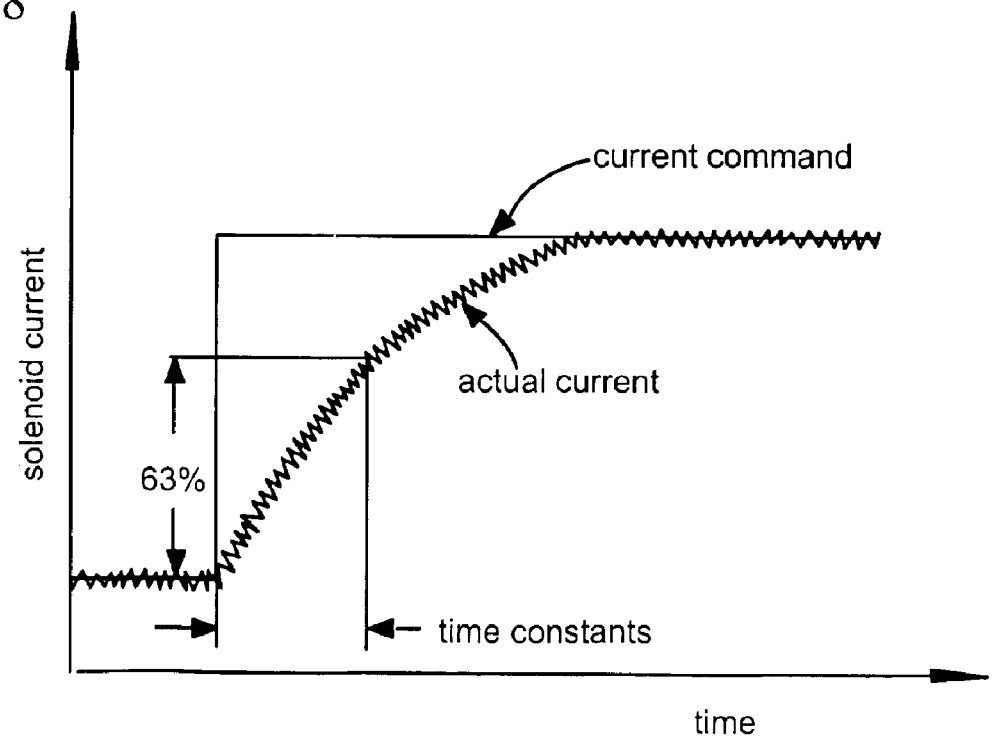
FIG. 8 shows a relationship of a solenoid current command with the actual current characteristics within the solenoid.
Figure 9:
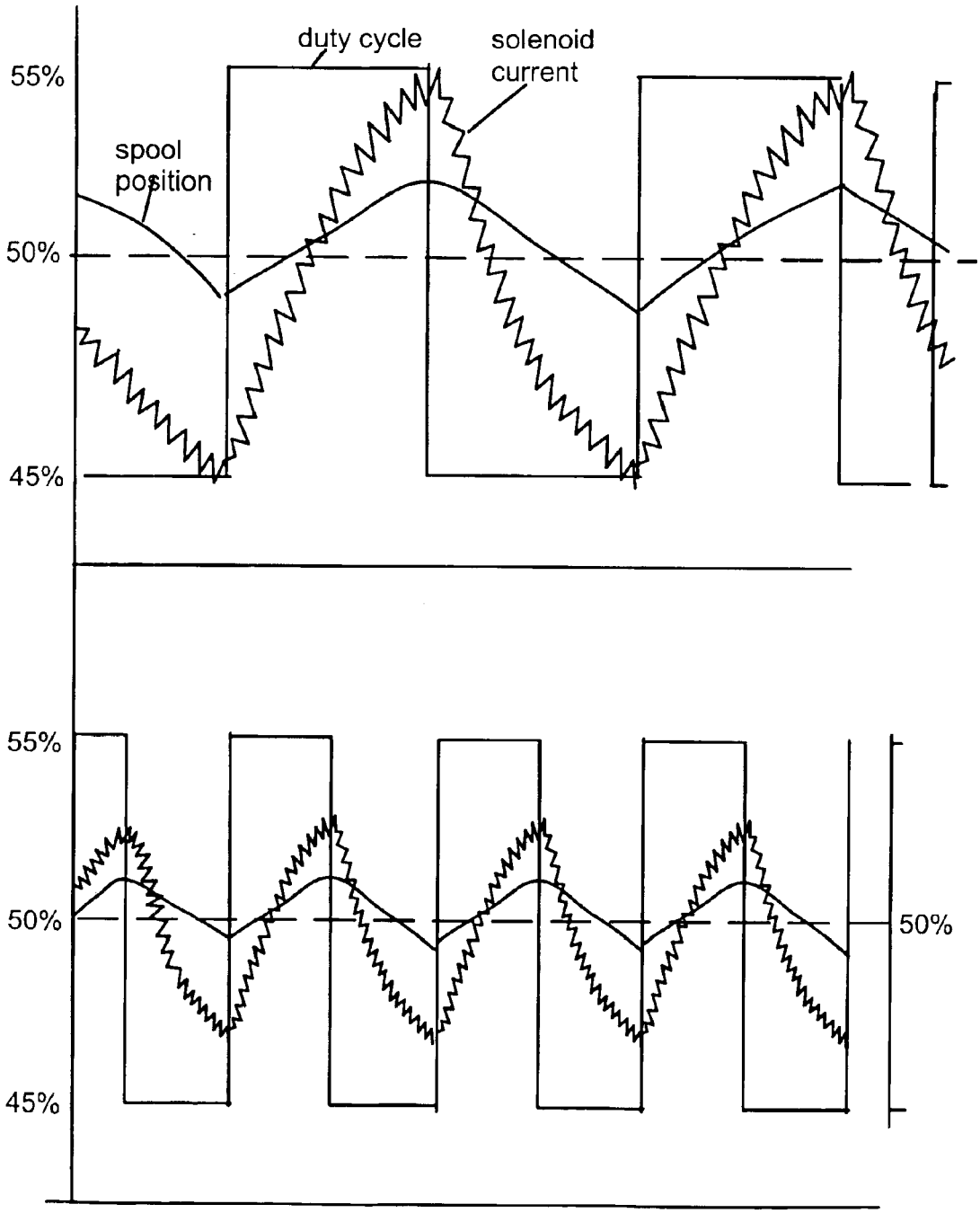
FIG. 9 shows the effect of current control dither frequency relating to solenoid currents and control spool valve positions.

In addition, there is an indirect effect on the dither amplitude that may be utilized for improved control. Since a solenoid device is inductive, the current rise in the device is not instantaneous but rises exponentially with a time constant that is a function of the inductance and resistance as shown in FIG. 8. Therefore, if the dither frequency range is chosen such that the dither current is attenuated at the higher frequencies (as shown in FIG. 9), then the amplitude of the dither current increases when the dither frequency is decreased at lower temperatures A third case of current control can be achieved by changing both dither amplitude and frequency. In this case, the controller may change both the dither amplitude and the frequency, directly. This works much the same as the first and second cases, but allows additional flexibility. The actual shape of the curves can be adjusted to provide the optimum performance.

As can be seen, by altering dither frequency and dither amplitude both individually and in combination over a temperature range, significant improvement can be achieved. For example, by decreasing the dither frequency and increasing the dither amplitude, the hysteresis of the control valve can be improved over the entire temperature range of an internal combustion engine. Further, the improvement also has a positive impact on the closed loop control of the system.

Four methods are possible depending on what aspects of the dither the controller can change dynamically as a function of temperature.

1. Current Control—Change dither amplitude only.

2. Current Control—Change dither frequency only.

3. Current Control—Change both dither amplitude and frequency.

4. PWM Control—Change both dither amplitude and frequency.

Three methods have been discussed supra, i.e., cases 1–3. A fourth case using pulse width modulation (PWM) control can be used to change both dither amplitude and frequency.

Figure 10A:
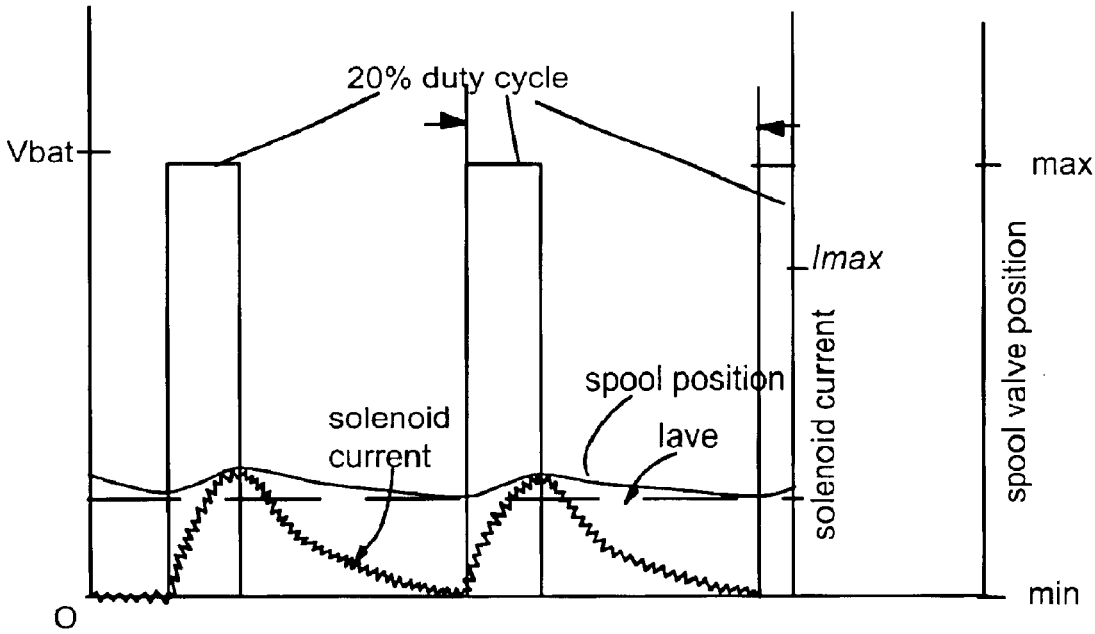
FIG. 10A shows the effect of a PWM control at 20% duty cycle.
Figure 10B:
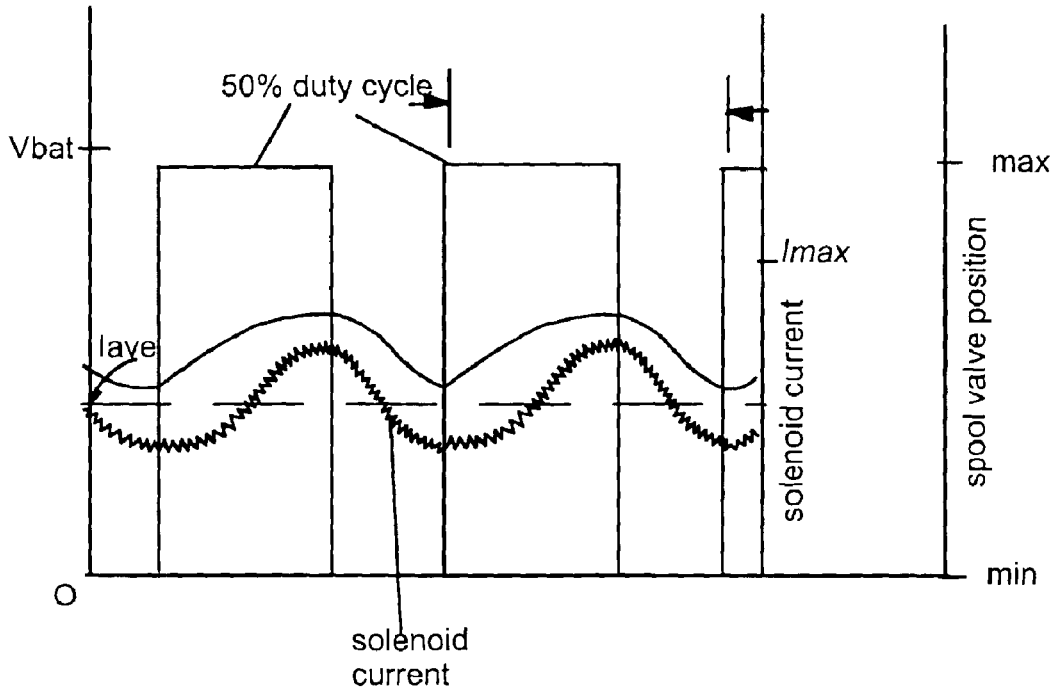
FIG. 10B shows the effect of a PWM control at 50% duty cycle.
Figure 10C:
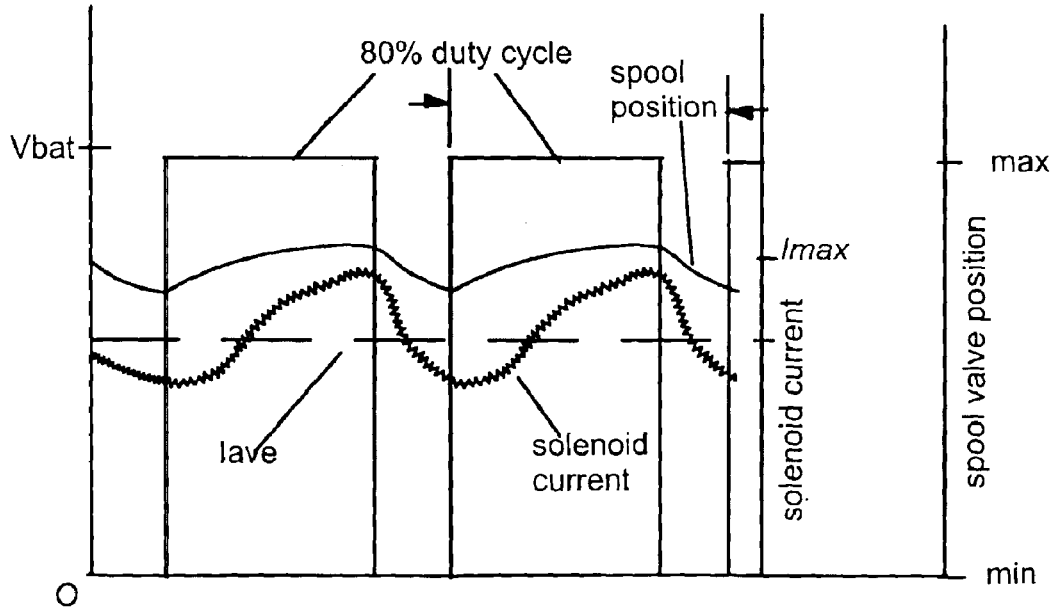
FIG. 10C shows the effect of a PWM control at 80% duty cycle.

With PWM control, there isn't a separate "dither" signal, like there is with a current control driver such as shown in cases 1–3. Rather, the dither effect is inherent in the PWM control signal. A set of power switch controlling the PWM pulse can be permitted to switch on and off at desired time points. With PWM control, the voltage applied to the solenoid is either 0 or full battery voltage (Vbat). The ratio of the time that the voltage is applied, to the time that the voltage is off, is called the duty cycle. The duty cycle is proportional to the average current through the solenoid (FIGS. 10A 10B, and 10C). The PWM frequency is chosen such that the ripple current variation through the solenoid causes only a small amount of movement in the control valve, in a similar fashion as in the current control cases depicted above. In FIG. 10A, a 20% duty cycle is shown; in FIG. 10B, a 50% duty cycle is shown, and in FIG. 10C, an 80% duty cycle is shown.

The PWM frequency can be changed as a function of temperature, to get the improved control at lower temperatures. At lower PWM frequencies, the resultant ripple current increases, allowing more time for the control valve to move as depicted in FIG. 11.

Figure 11A:
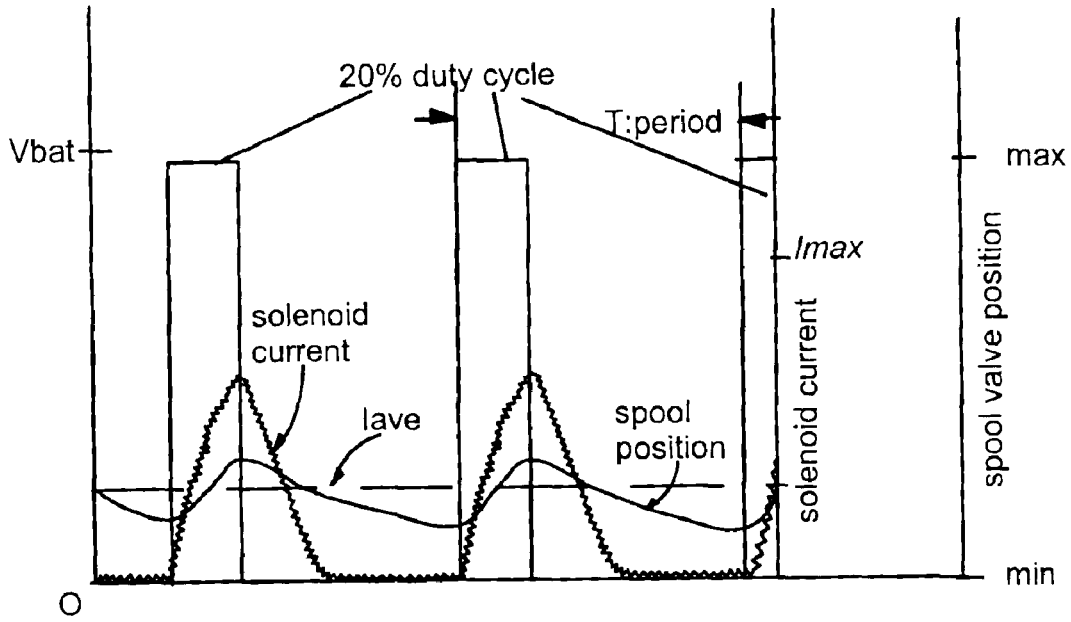
FIGS. 11A and 11B show the effect of lower frequency duty cycles of a PWM control upon solenoid currents and control spool valve positions.
Figure 11B:
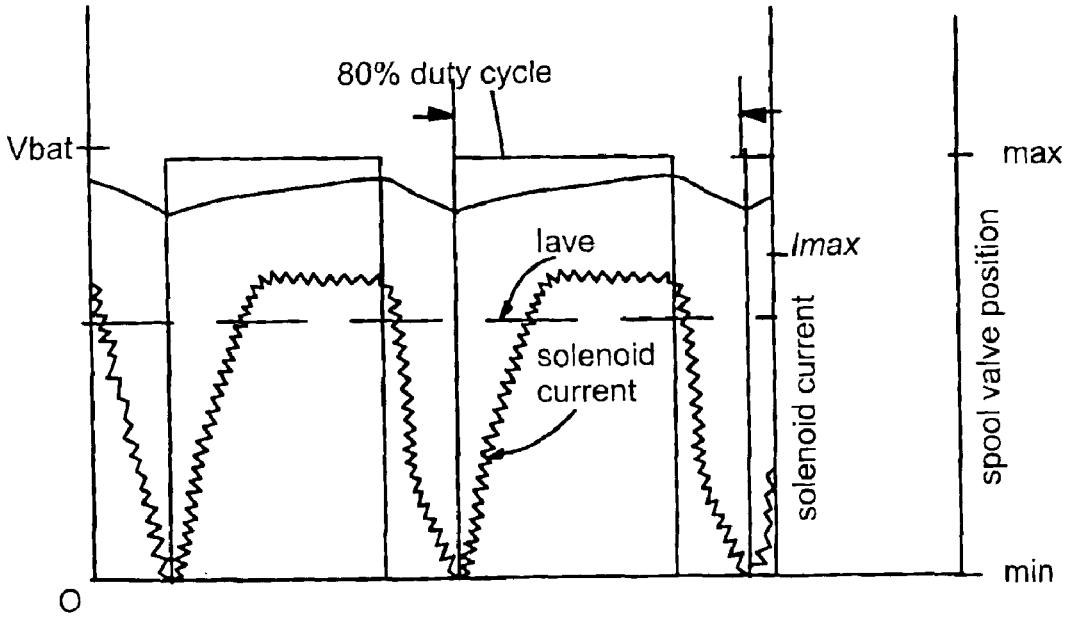

Referring to FIG. 11, being at a lower frequency than FIG. 10, there is more time for the current to build up to a relatively higher value. The building up process is similar to that of FIG. 9. At lower temperature ranges, a higher drag is exerted upon the spool, and a lower frequency PWM scheme is required to obtain improved control through reduction of hysteresis in the control valve.

The present invention may also be incorporated into a differential pressure control (DPCS) system included in a variable cam timing (VCT) system. The DPCS system includes an ON/OFF solenoid acting upon a fluid such as engine oil to control the position of at least one vane oscillating within a cavity to thereby forming a desired relative position between the a cam shaft and a crank shaft. As can be seen the ON/OFF solenoid of the DPCS system is not of the variable force solenoid type.

Furthermore, the present invention also contemplates its usage in conjunction with a PWM solenoid and a 4-way valve which may be located anywhere in the proximity of a phaser. A 4-way valve consists of a variable force solenoid and a hydraulic control valve are preferably incorporated into a single compact unit, thereby saving space.

In addition, an independent controller may be used instead of relying solely upon the engine control unit (ECU). The independent controller may be coupled to the ECU and communicate with the same. In other words, proprietary information may be stored in the memory of the independent controller, and the same may work in conjunction with the ECU.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. In a variable cam timing (VCT) system (10*a*) having a feedback control loop wherein an error signal (36) relating to at least one sensed position signal of either a crank shaft position (24*a*) or at least one cam shaft position (22*a*) is fed back for correcting a predetermined command signal (12), the system further having a valve (14) for controlling a relative angular relationship of a phaser (42) and having a variable force solenoid (20) for controlling a translational movement of the valve (14), an improved control method comprising the steps of:

providing a dither signal (38) sufficiently smaller than the error signal (36);

as temperature varies, changing at least one parameter relating to the dither signal (38); and applying the dither signal (38) upon the variable force solenoid (20), thereby using the dither signal (38) for overcoming a system hysteresis without causing excessive movement of valve (14).

2. The method of claim 1, wherein said at least one parameter is dither signal amplitude.

3. The method of claim 1, wherein said at least one parameter is dither signal frequency.

4. The method of claim 1, wherein said at least one parameter is a combination of dither signal amplitude and frequency.

5. In a variable cam timing (VCT) system (10*a*) having a feedback control loop wherein an error signal (36) relating to at least one sensed position signal of either a crank shaft position (24*a*) or at least one cam shaft position (22*a*) is fed back for correcting a predetermined command signal (12), the system further having a valve (14) for controlling a relative angular relationship of a phaser (42) and having a variable force solenoid (20) for controlling a translational movement of the valve (14), an improved control method comprising the steps of:

providing a pulse width modulation (PWM) signal disposed to generate a set of frequencies, wherein each frequency inherently includes a dither signal for overcoming system hysteresis at a predetermined temperature range; and as temperature varies, changing the frequency, thereby using the set of frequencies for overcoming a system hysteresis within a temperature range without causing excessive movement of valve (14).

* * * * *